US008741387B2

(12) United States Patent
Vontell et al.

(10) Patent No.: US 8,741,387 B2
(45) Date of Patent: Jun. 3, 2014

(54) PROCESS AND SYSTEM FOR DISTRIBUTING PARTICLES FOR INCORPORATION WITHIN A COMPOSITE STRUCTURE

(75) Inventors: John H. Vontell, Manchester, CT (US); John Putnam, Lindenhurst, IL (US)

(73) Assignee: United Technologies Corporation, Hartford, CT (US)

( * ) Notice: Subject to any disclaimer, the term of this patent is extended or adjusted under 35 U.S.C. 154(b) by 947 days.

(21) Appl. No.: 12/258,214

(22) Filed: Oct. 24, 2008

(65) Prior Publication Data

US 2010/0104741 A1 Apr. 29, 2010

(51) Int. Cl.

| | |
|---|---|
| ***B05D 1/12*** | (2006.01) |
| ***B05D 1/34*** | (2006.01) |
| ***B05D 7/00*** | (2006.01) |
| ***B05D 3/00*** | (2006.01) |

(52) U.S. Cl.
USPC ..... 427/294; 427/180; 427/295; 427/296; 427/221; 427/196

(58) Field of Classification Search
USPC ..... 148/420, 432, 437; 427/122, 212, 221, 427/222, 294, 295, 296, 372.2, 180, 196
See application file for complete search history.

(56) References Cited

U.S. PATENT DOCUMENTS

| | | | | |
|---|---|---|---|---|
| 2,879,904 | A | 3/1959 | Walsh et al. | |
| 4,056,874 | A * | 11/1977 | Kalnin | 148/420 |
| 4,359,151 | A | 11/1982 | Fyie et al. | |
| 4,809,575 | A | 3/1989 | Swanson | |
| 5,013,405 | A | 5/1991 | Izard | |
| 6,049,956 | A | 4/2000 | Lifke et al. | |
| 6,158,573 | A | 12/2000 | Janzen | |
| 6,214,451 | B1 | 4/2001 | Ihira et al. | |
| 6,216,848 | B1 | 4/2001 | Zens | |
| 6,251,978 | B1 * | 6/2001 | McCullough | 524/404 |
| 6,588,580 | B2 | 7/2003 | Janzen | |
| 6,611,659 | B2 | 8/2003 | Meisiek | |
| 6,622,870 | B1 | 9/2003 | Prinssen | |
| 6,838,162 | B1 | 1/2005 | Gruber et al. | |
| 6,997,549 | B2 | 2/2006 | Howarth et al. | |
| 7,222,727 | B2 | 5/2007 | Aisenbrey | |
| 2006/0086434 | A1 * | 4/2006 | Cornie et al. | 148/420 |
| 2008/0032049 | A1 | 2/2008 | Kosowsky et al. | |

FOREIGN PATENT DOCUMENTS

| | | |
|---|---|---|
| DE | 26 57 942 A1 | 8/1977 |
| WO | WO 2007/001421 | 1/2007 |

OTHER PUBLICATIONS

European Search Report, mailed Feb. 11, 2010.
"An Introduction to Horizontal Process Filters", from http://www.polyfilters.com/process.html, visited May 12, 2008 (3 pages).

(Continued)

*Primary Examiner* — Michael Wieczorek
(74) *Attorney, Agent, or Firm* — Kinney & Lange, P.A.

(57) ABSTRACT

A system and process is disclosed for binding particles to a carrier material in an isolated relationship for use in composite fabrication. A slurry comprising particles dispersed in fluid is created in particle suspension tanks, deposited as a uniform layer and filtered using reduced pressure applied to a filter belt to leave behind isolated particles, the reduced pressure further acting to overcome electrostatic and other forces of attraction between the particles until they can be permanently bound to the carrier with a binder or adhesive and collected on a take-up roll.

8 Claims, 9 Drawing Sheets

(56) References Cited

OTHER PUBLICATIONS

"Pannevis Horizontal Vacuum Belt Filters", from http://larox.com/CPI/products/pannevis/, visited May 12, 2008 (3 pages).
"Pannevis RT Horizontal Vacuum Belt Filter", from http://www.larox.com/CPI/products/pannevis/index.php?id=7, visited May 12, 2008 (2 pages).
"Schematic of counter current cake washing", from http://www.polyfilters.com/CC_wash.html, visited May 12, 2008 (1 page).
Brochure: "Pannevis "RT" Belt Filter Solves Difficult CPI Processing Problems", Pannevis RT Filters, LAROX® Chemical Process Industries, Apr. 2008 © Larox Corporation (2 pages).
Brochure: "Pannevis RT and GT Vacuum Filtration", LAROX® Chemical Process Industries, Mar. 2008 © Larox Corporation (1 page).
Brochure: "Principle of the Pannevis RT Vacuum Belt Filter", Pannevis RT Schematics, LAROX® Chemical Process Industries, Mar. 2008 © Larox Corporation (2 pages).
Brochure: "Pannevis RT Filter Dryer Systems Offer Multiple Options", Pannevis RT Filter Dryers, LAROX® Chemical Process Industries, Mar. 2008 © Larox Corporation (2 pages).
Brochure: "Pannevis RT Horizontal Vacuum Belt Filters from Larox for the Chemical Process Industries", Pannevis RT Filters, LAROX® Chemical Process Industries (3 pages), Date: Jan. 2007.

* cited by examiner

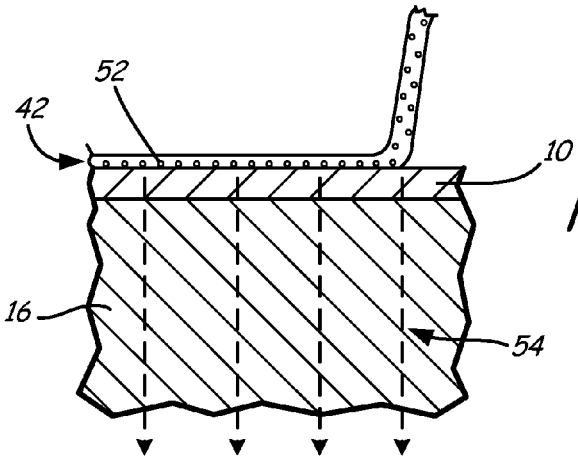
FIG. 1A
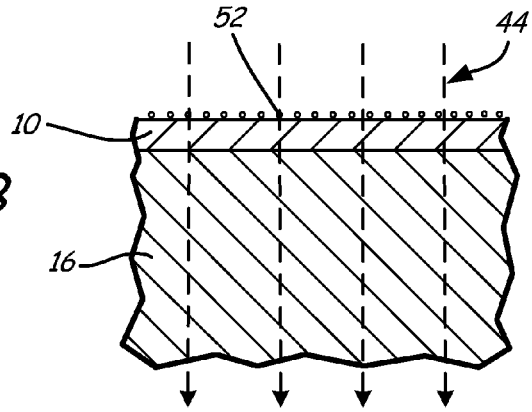
FIG. 1B
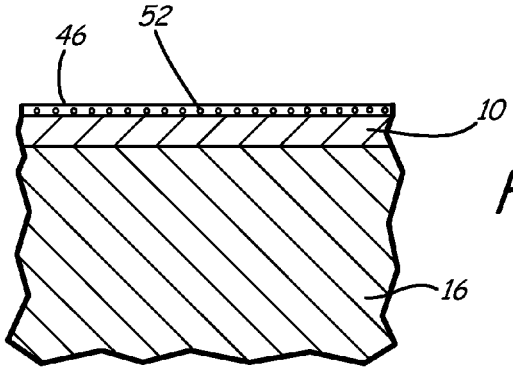
FIG. 1C
FIG. 1D
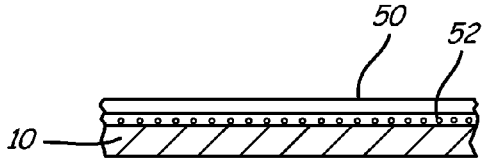

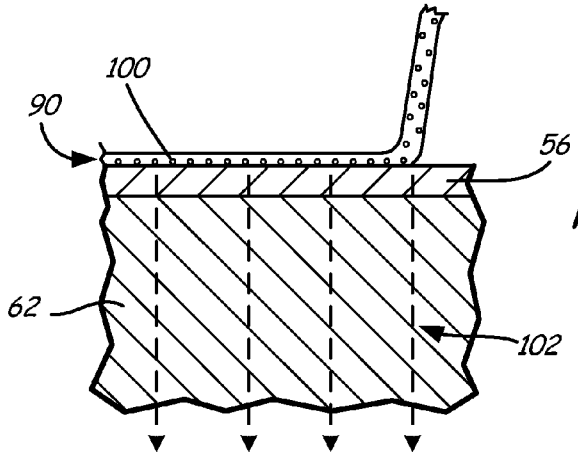
FIG. 3A
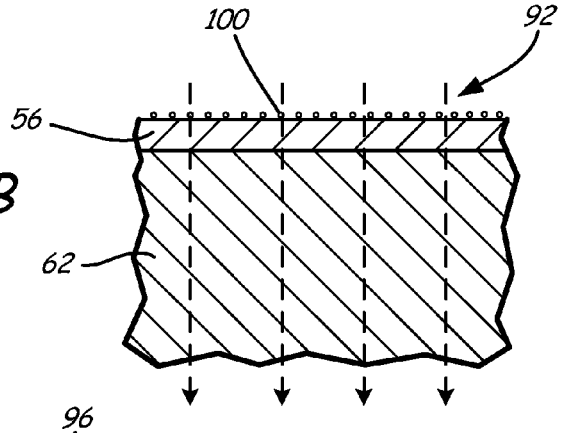
FIG. 3B
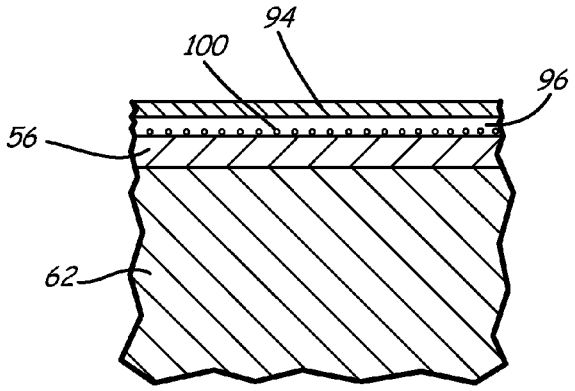
FIG. 3C
FIG. 3D
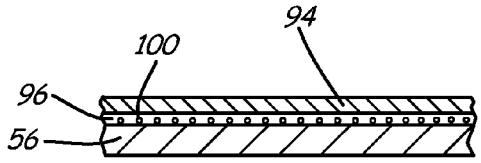

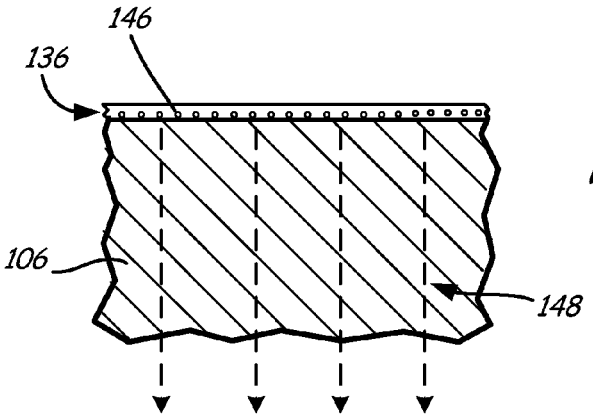
FIG. 4A
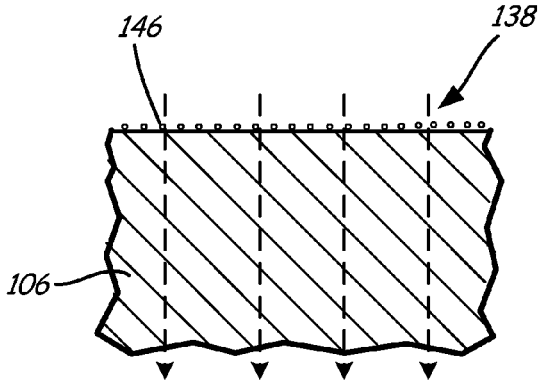
FIG. 4B
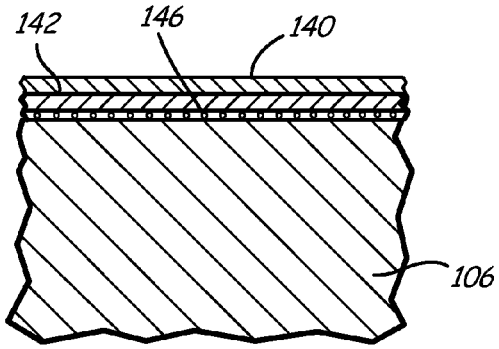
FIG. 4C
FIG. 4D
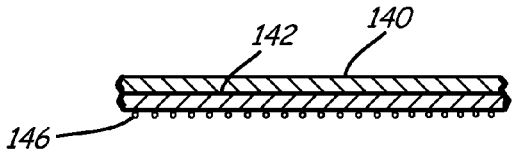

PROCESS AND SYSTEM FOR DISTRIBUTING PARTICLES FOR INCORPORATION WITHIN A COMPOSITE STRUCTURE

STATEMENT OF GOVERNMENT INTEREST

The U.S. Government has a paid-up license in this invention and the right in limited circumstances to require the patent owner to license others on reasonable terms as provided for by the terms of Contract No. N00019-02-C-3003 awarded by the Navy.

BACKGROUND

It is sometimes desirable to incorporate particles of various kinds into composite structures such that they are isolated from one another. As an example, hard particles are often incorporated into soft matrix composites in a dispersed relationship to provide strength to the composite. If such particles are allowed to conglomerate, the resulting composite will be less tolerant of stress fracturing under tension. However, creating a dispersed relationship of particles in composites can prove difficult when such particles have properties that cause them to attract each other and stick together. For example, some aerospace composite structures require the incorporation of electrically conducting high aspect ratio particles, such as carbon fibers, to be fixed in a spaced relationship so that the particles are electrically isolated from one another. Unfortunately, the electrostatic interaction between these particles causes them to stick together before they can be secured in a dispersed, electrically isolated relationship within the composite structure to be formed. This problem is particularly present in the dry application of particles to carrier materials supplied in web format, for example, fabric, discontinuous fiber mat, or veil, which are to be handled in aerospace composite fabrication processes such as autoclave, compression, and resin transfer molding.

SUMMARY

A system and process are disclosed for dispersing particles and stabilizing them in an isolated relationship until they can be bound to a carrier material and retained in that relationship for use in composite fabrication processes.

BRIEF DESCRIPTION OF THE DRAWINGS

FIGS. 1A-1D are blown-up cross sections of the system and process of FIG. 1, showing various stages of the system and process in more detail.

FIGS. 3A-3D are blown-up cross sections of the system and process of FIG. 3, showing various stages of the system and process in more detail.

FIGS. 4A-4D are blown-up cross sections of the system and process of FIG. 4, showing various stages of the system and process in more detail.

DETAILED DESCRIPTION

Described herein is a system and process for dispersing particles and stabilizing them in a spaced, isolated relationship until they can be secured to a carrier material in that relationship for easy handling and incorporation into composite structures. To accommodate the typical web format of carrier materials used in composite fabrication processes, a continuous method is further disclosed. For polymer, ceramic, or metal matrix composite applications requiring the incorporation of particles in an evenly spaced, dispersed, or isolated relationship, the dry handling and application of particles can present difficulties as such particles often have the tendency to stick together via electrostatic interactions or other forces of attraction or adhesion. This is particularly true in the manufacture of aircraft composites requiring the incorporation of electrically conductive high aspect ratio carbon fibers in an electrically isolated arrangement, and also may apply to the incorporation of particles into composites for the purposes of strengthening such composites. Utilizing the system and process disclosed herein, problems of electrostatic interactions and other forces causing particles to conglomerate can successfully be overcome, thereby facilitating the manufacture of composite structures comprising evenly dispersed, isolated particles. The system and process of the present disclosure further provides an increased level of efficiency for the manufacture of composite structures through the disclosure of a continuous process that yields a rolled carrier material with stably bound, isolated particles for easy handling and incorporation into a variety of applications.

Figure 1:
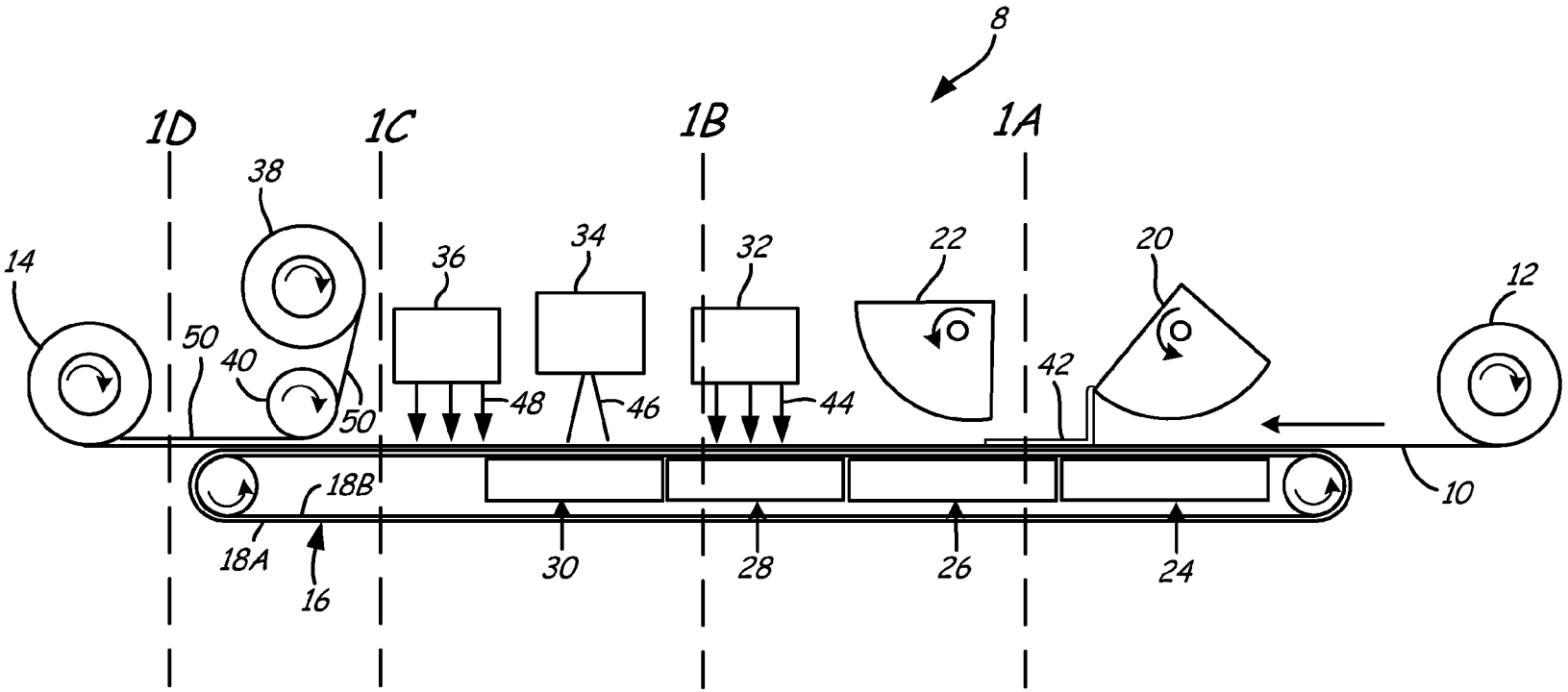
FIG. 1 is a schematic diagram showing a system and process for applying particles to a carrier in an isolated relationship.

FIG. 1 shows system and process 8 for binding particles to carrier 10 in a stable, isolated relationship. System and process 8 includes feed roll 12, take-up roll 14, movable filter belt 16 (having first surface 18A and second surface 18B), suspension tanks 20 and 22, troughs 24, 26, 28, and 30, drying station 32, binder application station 34, energy station 36, release film feed roll 38, and consolidation roller 40.

As shown in FIG. 1, feed roll 12 supplies carrier 10 to first surface 18A of movable filter belt 16. Second surface 18B of filter belt 16 runs over and flush with troughs 24, 26, 28, and 30. Proceeding generally downstream of feed roll 12 are particle suspension tanks 20 and 22 which deposit particle slurry 42 onto carrier 10, drying station 32 for providing energy in the form of heated air 44 for drying, binder application station 34 for providing binder 46, energy station 36 for providing energy 48, release film feed roll 38 for feeding release film 50, consolidation roller 40, and finally take-up roll 14.

The particles of the present disclosure may comprise, for example, single filament electrically conductive high aspect ratio carbon fibers approximately ⅛" long and 10 microns in diameter, or may comprise any other type of particle small enough to have a tendency of sticking together via electrostatic forces or other forces of attraction. Carrier 10 may comprise fabric, veil, or mat, for example, or other carrier materials commonly used for the fabrication of polymer matrix composites, and should be fluid permeable. If electrically conductive high aspect ratio carbon fibers are applied to carrier 10, then carrier 10 should be of non-conductive or insulative properties such that the fibers may remain electrically insulated from one another when bound in an isolated relationship on carrier 10.

Carrier 10 is provided by feed roll 12 and ultimately collected in take-up roll 14. Take-up roll 14 may be mechanized to advance carrier 10 from feed roll 12. Carrier 10 is fed onto a first surface 18A of the movable filter belt 16, the filter belt 16 being of fluid-permeable construction. Carrier 10 and filter belt 16 should be controlled to advance at the same rate, with carrier 10 lying flush with the filter belt 16 first surface 18A. Particle suspension tanks 20 and 22 are filled with particles and a fluid, the fluid preferably comprising water. Each particle suspension tank 20 and 22 is capable of dispersing the particles via agitation, for example, by ultrasonic energy or mechanical stirring, to create particle slurry 42. Furthermore, each particle suspension tank 20 and 22 is rotatable and geometrically designed such that if rotated at a constant speed, a constant flow rate of particle slurry 42 is uniformly poured out onto carrier 10. By adjusting the rate of rotation of the particle suspension tanks 20 and 22, along with the feed rate of carrier 10 from feed roll 12, the rate of distribution of particle slurry 42 onto carrier 10 can be controlled. To ensure the continual depositing of a layer of particle slurry 42 onto carrier 10, each particle suspension tank 20 and 22 may operate synchronously such that while one tank is being emptied and poured onto carrier 10, the other is being charged with more particle slurry 42 (described in more detail with reference to FIGS. 2A-2E). Further, it can be appreciated that any number of particle suspension tanks 20 and 22 may be used as needed.

A vacuum or gas flow applied to troughs 24 and 26 creates a reduced pressure on a second surface 18B of filter belt 16 to draw the fluid from the deposited particle slurry 42 through fluid-permeable carrier 10 and the filter belt 16. Vacuum filter belts with troughs having a reduced pressure are commercially available, and may be purchased from Larox® Corporation. As the fluid is drawn from the deposited particle slurry 42 through carrier 10 and filter belt 16, carrier 10 will function, like filter belt 16, as a filter that keeps the dispersed particles from passing through carrier 10, thereby leaving behind isolated particles on the carrier 10 surface or embedded in that surface. The particles will be isolated due to the dispersed nature of the particles in particle slurry 42. Carrier 10 must be tightly woven enough or possess pores small enough so as to prevent the significant pass through of the dispersed particles, yet nonetheless allow for fluid permeability. Similarly, filter belt 16 must have pores of a size to prevent a significant quantity of particles from passing through the belt or lodging into the pores, while allowing for fluid permeability.

FIG. 1A is a cross section of the process and system 8 of FIG. 1, showing the deposited particle slurry layer 42 comprising dispersed particles 52 on carrier 10. Reduced pressure is shown drawing fluid 54 through carrier 10 and filter belt 16.

The reduced pressure in the troughs 24 and 26 further creates a positive down draft air flow that functions to not only dry residual fluid remaining in carrier 10 and attached to particles 52, but to also stabilize particles 52 in their isolated relationship to the carrier 10 until particles 52 can be permanently bound to the carrier 10 in that relationship by application of binder 46 at binder application station 34. Optionally, if the down draft air flow is not sufficient to dry particles 52, particularly if a water-intolerant binder 46 is to be used, a drying station 32 may be used to provide energy, such as heated air, down through carrier 10, filter belt 16 and into trough 28. In such case, particles 52 will then continue to be held in place by the positive down draft heated air flow 44 provided by drying station 32 until reaching the binder application station 34. Additionally, a reduced pressure may be applied to trough 28 to assist in stabilizing particles 52 on carrier 10 surface. It may be appreciated that any number of troughs can be used, the amount of reduced pressure or vacuum applied to each trough being independently controllable as needed to stabilize particular particles 52 being handled in an isolated relationship.

FIG. 1B is a cross section of process and system 8 of FIG. 1, showing dry particles 52 in an isolated relationship on carrier 10, with a down draft air flow 44 stabilizing particles 52 in their isolated relationship.

At binder application station 34, a vacuum applied to trough 30 will continue to stabilize particles 52 in their isolated position until binder 46 is applied to particles 52 and carrier 10 to permanently stabilize particles 52 in their position on carrier 10. Binder 46 can be a liquid binder, liquid slurry, or 100% solid binder, and preferably comprises a soluble polymer that is compatible with the final composite to be formed. In case of liquid type binders, binder 46 may be sprayed or curtain-walled onto particles 52 and carrier 10. Otherwise, techniques such as vibration dispersion may be used to apply solid heat fusible binder powders onto particles 52 and carrier 10. In addition to stabilizing particles 52 in their isolated relationship until application of binder 46, the positive down draft air flow created by the negative pressure in trough 30 flowing past particles 52 and through carrier 10 may further function to evaporate any solvent or fluid in binder 46 for controlled disposal, and may assist in setting binder 46 depending on the type of binder 46 used. Subsequently, if necessary for the particular binder 46 used, an energy station 36 can provide energy 48 for melting, fusing, drying, or putting a degree of cure into binder 46 to bring the binder-particle-carrier combination into a more stable state for rolling and subsequent handling. The degree of cure imparted to binder 46 will depend on, for example, whether making the final composite structure requires binder 46 to mix with resin injected into the polymer composite matrix for later curing of the composite structure to be formed. Energy 48 can include thermal heat, hot air, radiant heat from electrical sources, or electromagnetic energy, for example, and may either be directly applied to carrier 10 and binder 46, or indirectly via a fluid such as air or nitrogen. If a hard binder 46 is used, energy 48 may be provided for the purpose of softening binder 48 to make it compatible with the later formation and curing of the final composite structure.

FIG. 1C is a cross section of the process and system 8 of FIG. 1, showing particles 52 stably bound in an isolated relationship to carrier 10 via binder 46.

Once particles 52 are stably bound to carrier 10 in their isolated relationship, carrier 10 with bound particles 52 may then be collected on take-up roll 14 for convenient handling in the fabrication of polymer composite structures, including aerospace composite fabrication processes such as autoclave, compression and resin transfer molding. To prevent carrier 10 coated with bound isolated particles 52 from adhering to itself on take-up roll 14, release film 50 from release film feed roll 38 may be applied to carrier 10 via consolidation roller 40. Consolidation roller 40 may be chilled to cool the binder-particle-carrier combination if still hot from application of energy 48. Chilling can be performed using methods such as circulated chilled oil, chilled water or refrigerant, for example.

FIG. 1D is a cross section of process and system 8 of FIG. 1, showing release film 50 layered on top of the bound isolated particles 52 prior to entering take-up roll 14.

Figure 2A:
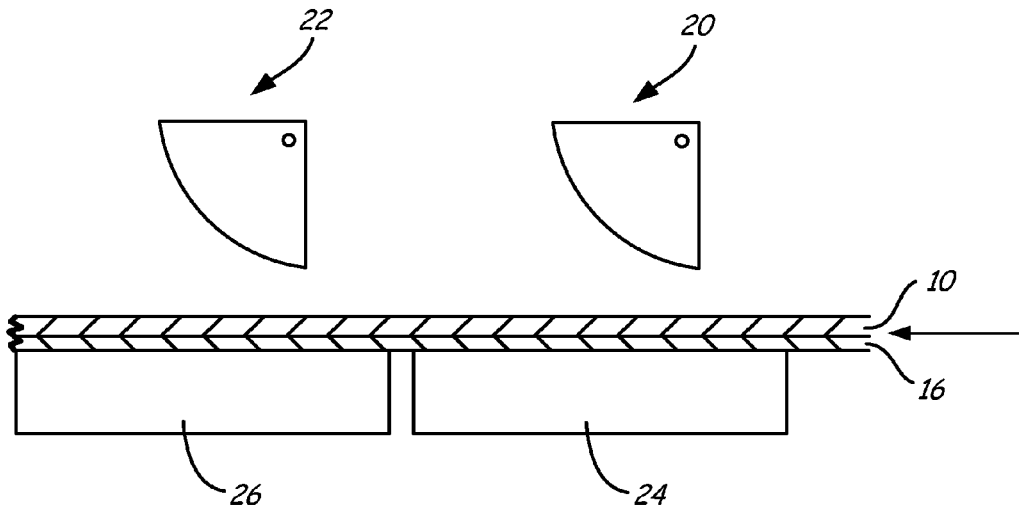
FIGS. 2A-2E are schematic diagrams showing the synchronous operation of the particle suspension tanks of the present disclosure.
Figure 2B:
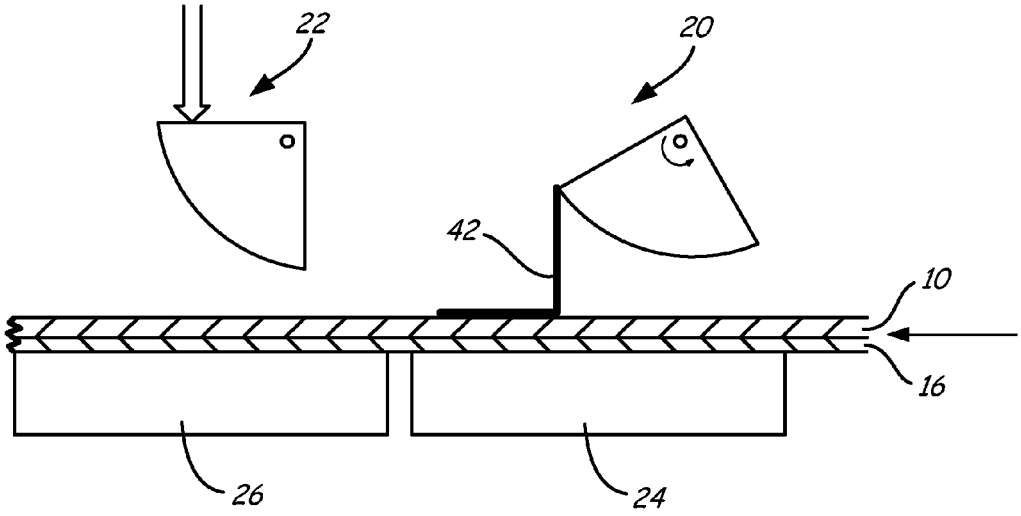
Figure 2C:
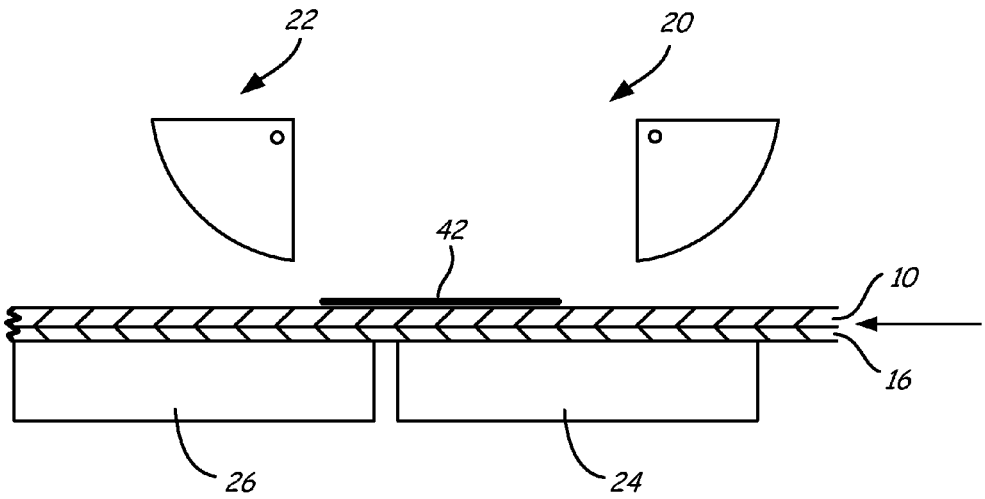
Figure 2D:
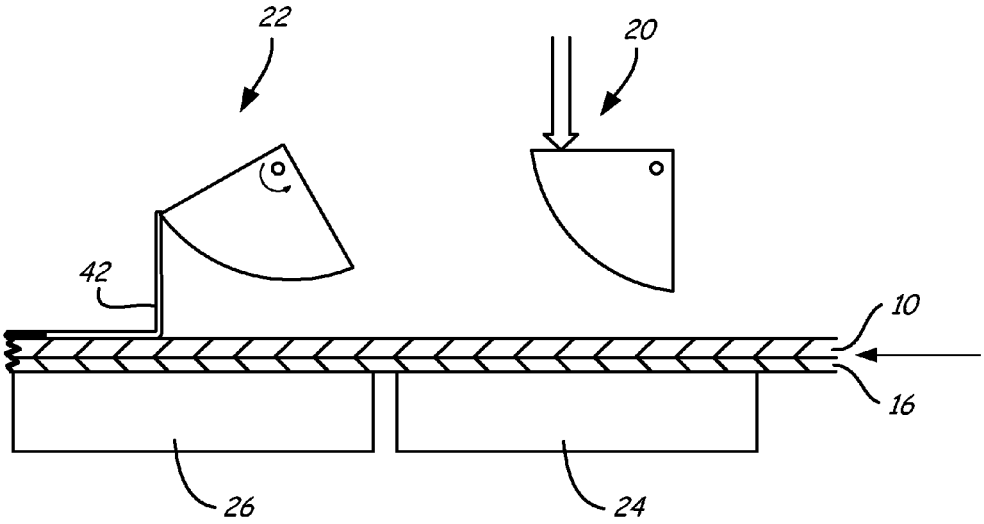
Figure 2E:
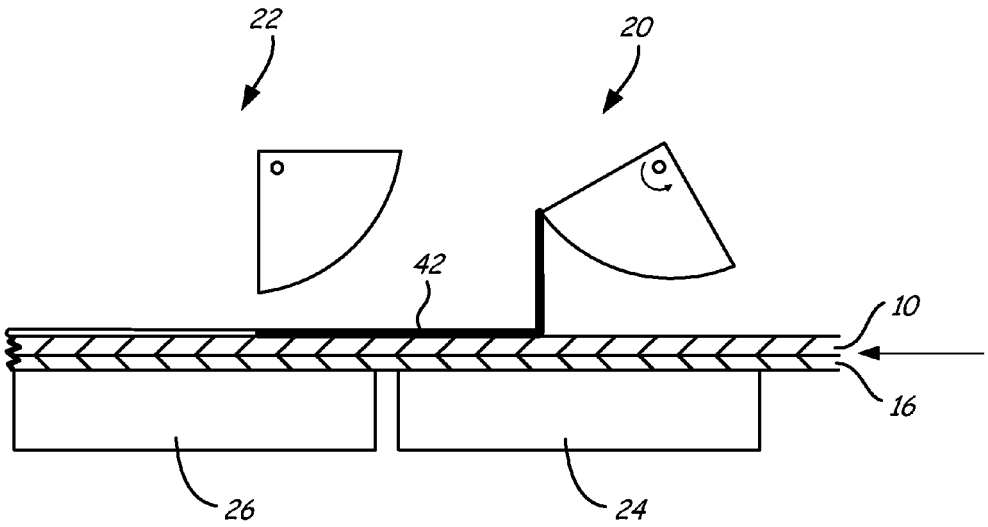

FIGS. 2A-2E show the synchronous operation of particle suspension tanks 20 and 22. FIG. 2A shows tanks 20 and 22 at the start of the pour cycle. Tank 20 is filled with dispersed particle slurry 42, and tank 22 is empty. In FIG. 2B, tank 20 pours dispersed particle slurry 42 onto carrier 10, while tank 22 is charged with particles and fluid to create a new batch of slurry 42. In FIG. 2C, tank 20 has completed pouring and is empty. Tank 22 will then start pouring at a time controlled to continue the deposition of slurry 42 by tank 20 so there is a continuous particle slurry 42 deposition on the carrier 10. In FIG. 2D, tank 20 has returned to the starting position and is charged with particles and fluid to create a new batch of slurry 42. Meanwhile, tank 22 pours to create a continuous layer of slurry 42 on carrier 10 where tank 20 left off. In FIG. 2E, tank 22 has completed pouring. Tank 20 is shown pouring at a time controlled to continue the tank 22 deposition of particle slurry 42 so there is a continuous deposition on carrier 10. This is achieved by tank 20 starting its pouring cycle just prior to the point where tank 22 finished. The cycle then continues with tank 22 returning to its starting position and being recharged with a new batch of particle slurry 42.

Figure 3:
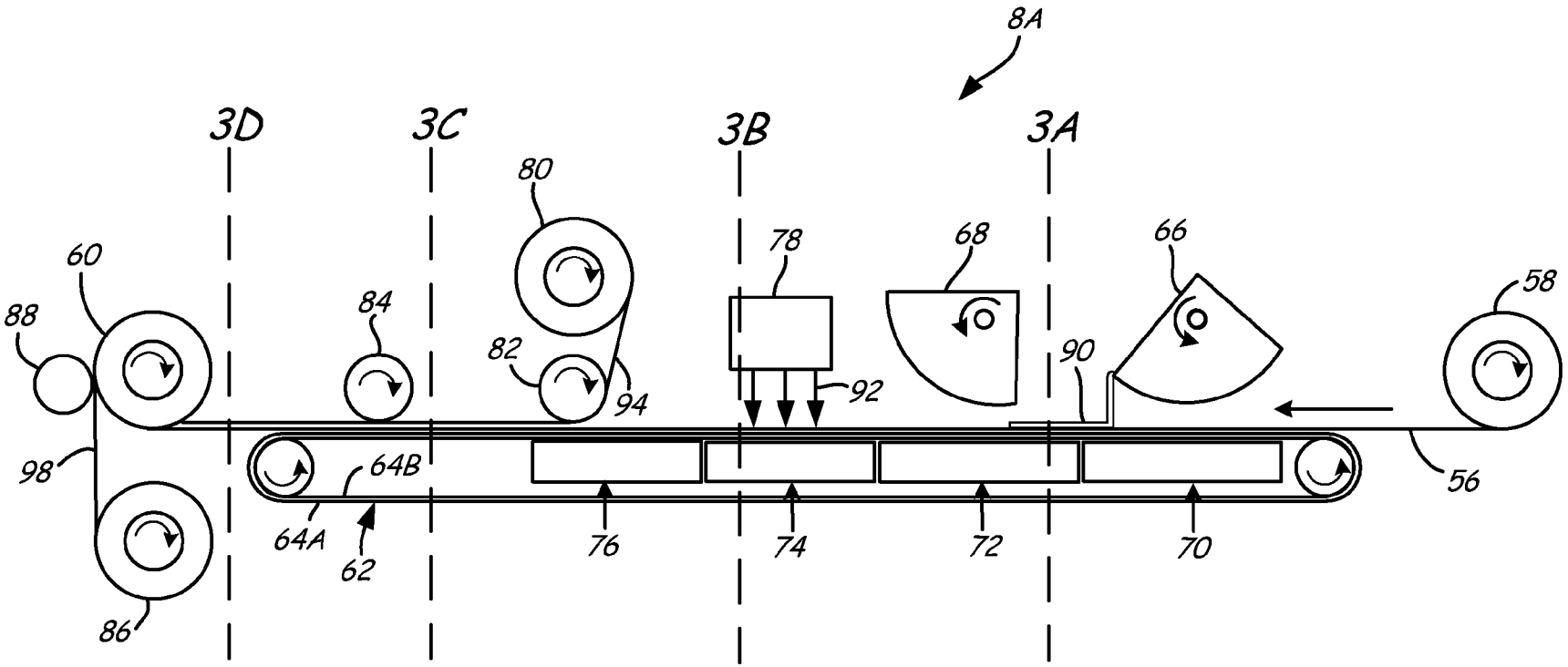
FIG. 3 is a schematic diagram showing another system and process for applying particles to a carrier in an isolated relationship.

FIG. 3 shows another system and process 8A for applying particles to carrier 56 in a stable, isolated relationship. The system and process 8A of FIG. 3 includes feed roll 58, take-up roll 60, movable filter belt 62 (having first surface 64A and second surface 64B), suspension tanks 66 and 68, troughs 70, 72, 74, and 76, drying station 78, binder release film feed roll 80, heated consolidation roller 82, chilled roller 84, release film feed roll 86, and pressure roller 88.

As shown in FIG. 3, feed roll 58 supplies carrier 56 to first surface 64A of movable filter belt 62. Second surface 64B of filter belt 62 runs over and flush with troughs 70, 72, 74, and 76. Proceeding generally downstream of feed roll 58 are particle suspension tanks 66 and 68 which deposit particle slurry 90 onto carrier 56, drying station 78 for providing energy in the form of heated air 92 for drying, binder release film feed roll 80 for supplying binder release film 94 coated with binder 96 (binder 96 shown in FIG. 3C and FIG. 3D), binder 96 applied via heated consolidation roller 82, and chilled roller 84 for cooling down the temperature of binder release film 94 and binder 96. Optional equipment for the addition of a second release film include release film feed roll 86 for feeding release film 98, pressure roller 88 for applying pressure to the release film 98, and finally take-up roll 60.

Carrier 56 is provided by feed roll 58 onto first surface 64A of movable filter belt 62. Particle suspension tanks 66 and 68 are filled with particles and are operated to create particle slurry 90 via agitation. Particle slurry 90 is deposited onto carrier 56 using the method described with reference to FIGS. 2A-2E. A vacuum or gas flow applied to troughs 70 and 72 creates a reduced pressure on second surface 64B of filter belt 62 to draw the fluid from the deposited slurry 90 through fluid-permeable carrier 56 and filter belt 62, leaving behind isolated particles on carrier 56 surface or embedded in that surface.

FIG. 3A is a cross section of process and system 8A of FIG. 3, showing the deposited particle slurry layer 90 comprising dispersed particles 100 on carrier 56. Reduced pressure is shown drawing fluid 102 through carrier 56 and filter belt 62.

The reduced pressure applied to troughs 70 and 72 furthermore creates a positive down draft air flow that functions to dry residual fluid remaining in carrier 56 and attached to particles 100 and to stabilize particles 100 in their isolated relationship to carrier 56 until they can be permanently bound to carrier 56 in that relationship by application of binder 96. If necessary, drying station 78 may be used to provide energy, such as heated air 92, down through carrier 56, filter belt 62, and into trough 74 to provide additional drying prior to application of binder 96. Additionally, a reduced pressure may be applied to trough 74 to assist in stabilizing particles 100 on carrier 56 surface. It may be appreciated that any number of troughs can be used, the amount of reduced pressure or vacuum applied to each trough independently controllable as needed to stabilize the particular particles 100 being handled in an isolated relationship.

FIG. 3B is a cross section of process and system 8A of FIG. 3, showing dry particles 100 in an isolated relationship on carrier 56, with down draft air flow 92 stabilizing the particles 100 in their isolated relationship.

Binder 96 coated on release film 94 fed from binder release film feed roll 80 is applied to carrier 56 and particles 100 using heated consolidation roller 82. Roller 82 may be heated using methods such as circulated heated oil, heated water, or electric heat. It may be appreciated that a hot melt adhesive may alternatively be applied in a similar manner.

FIG. 3C is a cross section of process and system 8A of FIG. 3, showing binder 96 applied to isolated particles 100 and carrier 56 with binder release film 94 still attached.

If needed, the application of binder 96 from release film 94 via heated roller 82 may be followed by chilled roller 84 to cool down binder 96 and release film 94.

FIG. 3D is a cross section of the process and system 8A of FIG. 3, showing release film 94 with binder 96 coated on top of bound isolated particles 100 and carrier 56 prior to entering take-up roll 60.

To prevent carrier 56 coated with bound isolated particles 100 from adhering to release film 94 in take-up roll 60, release film 98 may be supplied by release film feed roll 86 and applied by pressure roller 88.

Figure 4:
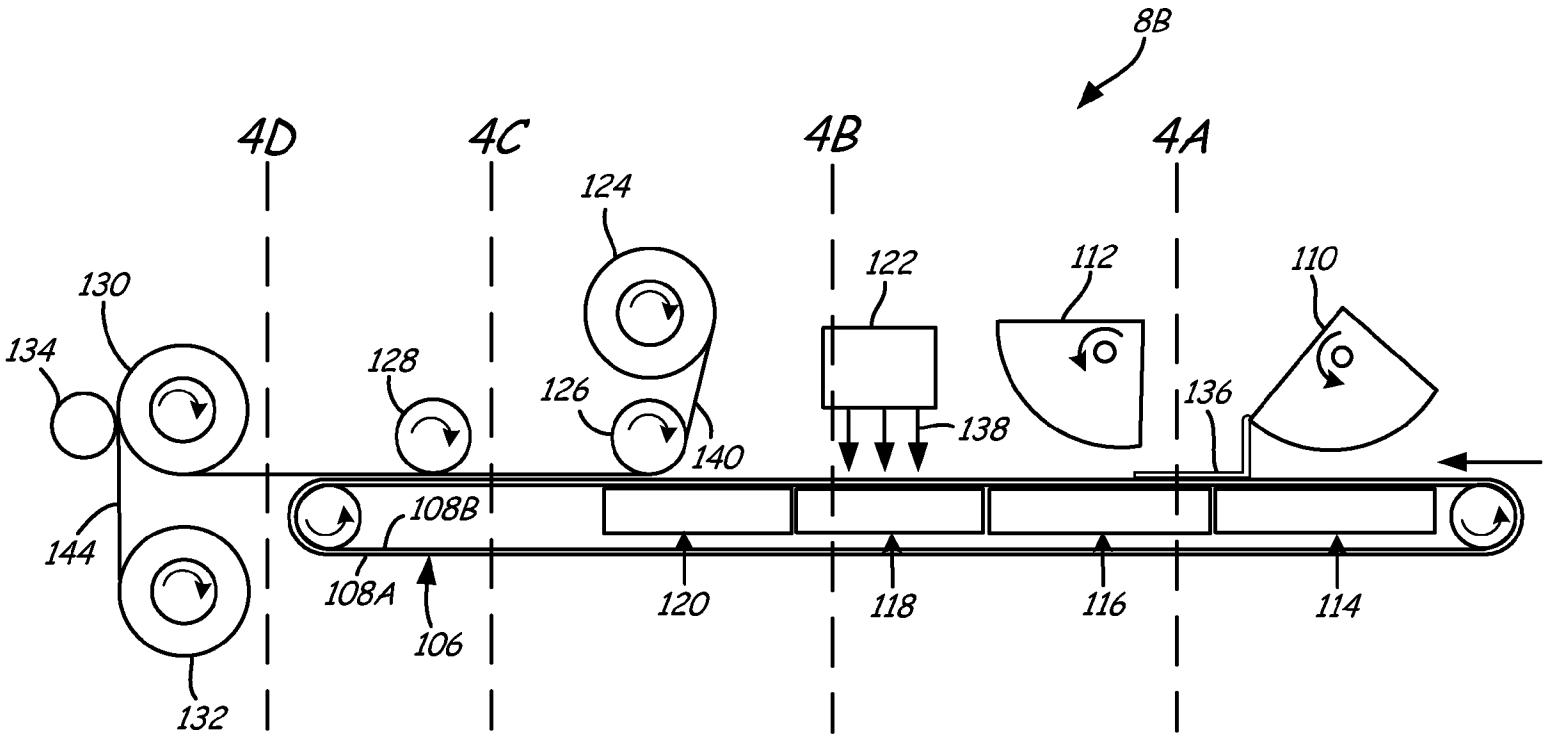
FIG. 4 is a schematic diagram showing another system and process for applying particles to a carrier in an isolated relationship.

FIG. 4 shows another system and process 8B for applying particles to carrier 104 in a stable, isolated relationship. System and process 8B of FIG. 4 includes movable filter belt 106 (having first surface 108A and second surface 108B), suspension tanks 110 and 112, troughs 114, 116, 118, and 120, drying station 122, adhesive film feed roll 124, heated consolidation roller 126, chilled roller 128, take-up roll 130, release film feed roll 132, and pressure roller 134.

As shown in FIG. 4, second surface 108B of filter belt 106 runs over and flush with troughs 114, 116, 118, and 120. Proceeding generally from upstream to downstream are particle suspension tanks 110 and 112 which deposit particle slurry 136 onto filter belt 106 first surface 108A, drying station 122 for providing energy in the form of heated air 138 for drying, adhesive film feed roll 124 for supplying release film 140 coated with adhesive film 142 (adhesive film 142 shown in FIG. 4C and FIG. 4D) via heated consolidation roller 126, chilled roller 128 for cooling down the temperature of adhesive film 142, release film feed roll 132 for feeding release film 144, pressure roller 134 for applying pressure to the release film 144, and finally take-up roll 130.

Particle suspension tanks 110 and 112 are filled with particles and are operated to create a particle slurry 136 via agitation. Particle suspension tanks 110 and 112 operate synchronously as described with reference to FIGS. 2A-2E, except that in system and process 8B of FIG. 4, particle slurry 136 is deposited directly onto first surface 108A of filter belt 106. Filter belt 106 is fluid permeable but possesses pores small enough to prevent the significant pass through of any particles into troughs 114, 116, 118, and 120. A vacuum or gas flow applied to troughs 114 and 116 creates a reduced pressure on second surface 108B of filter belt 106 to draw the fluid from deposited slurry 136 through filter belt 106.

FIG. 4A is a cross section of process and system 8B of FIG. 4, showing deposited slurry layer 136 comprising dispersed particles 146 on filter belt 106. Reduced pressure is shown drawing fluid 148 through filter belt 106.

The reduced pressure, as it draws fluid from the particle slurry through filter belt 106, leaves behind isolated particles 146 on filter belt 106 first surface 108A or embedded in that surface. The reduced pressure furthermore creates a positive down draft air flow that functions to dry residual fluid remaining on filter belt 106 and attached to particles 146 and to stabilize particles 146 in their isolated relationship to filter belt 106 until they can be permanently bound to adhesive film 142. If necessary, drying station 122 may be used to provide energy, such as heated air 138, down through filter belt 106 and into trough 118 to provide additional drying prior to application of adhesive film 142. Additionally, a reduced pressure may be applied to trough 118 to assist in stabilizing particles 144 on filter belt 106 first surface 108A. It may be appreciated that any number of troughs can be used, the amount of reduced pressure or vacuum applied to each trough independently controllable as needed to stabilize the particular particles 146 being handled in an isolated relationship.

FIG. 4B is a cross section of process and system 8B of FIG. 4, showing dry particles 146 in an isolated relationship on filter belt 106, with down draft air flow 138 stabilizing particles 146 in their isolated relationship.

Adhesive film 142 coated on release film 140 is brought into contact with first surface 108A of filter belt 106 by heated consolidation roller 126. Particles 146, stabilized in an isolated relationship on first surface 108A via negative pressure applied to trough 120, will then be bound to and stabilized in an isolated relationship on adhesive film 142.

FIG. 4C is a cross section of process and system 8B of FIG. 4, showing particles 146 stably bound to adhesive film 142 coated on release film 140 in an isolated relationship on filter belt 106.

To cool adhesive film 142 coated on release film 140 for easier handling and to help set the adhesive to ensure stabilization of particles 146, optional chilled roller 128 may be provided downstream.

FIG. 4D is a cross section of process and system 8B of FIG. 4, showing particles 146 stably bound to adhesive film 142 coated on release film 140 in an isolated relationship prior to entering take-up roll 130.

Adhesive film 142 coated on release film 140 with bound particles 146 may then be collected in take-up roll 130 for convenient handling in the fabrication of polymer composite structures, including aerospace composite fabrication processes such as autoclave, compression and resin transfer molding. Furthermore, if needed, release film 144 may be supplied by release film feed roll 132 and applied by pressure roller 134 to prevent adhesive film 142 with bound isolated particles 146 from adhering to release film 140 in take-up roll 130.

Although the present invention has been described with reference to preferred embodiments, workers skilled in the art will recognize that changes may be made in form and detail without departing from the spirit and scope of the invention.

The invention claimed is:

1. A process comprising:

forming a slurry comprising dispersed, high aspect ratio particles in a fluid;

agitating the slurry in a suspension tank;

pouring the slurry from the suspension tank onto an electrically insulative carrier, which creates a layer of the slurry in which the particles are spaced apart and electrically isolated from one another;

removing fluid from the slurry to create a layer of particles in an electrically isolated relationship from one another;

stabilizing the particles in the electrically isolated relationship from one another on the electrically insulative carrier; and binding the particles to the electrically insulative carrier in the electrically isolated relationship from one another.

2. The process of claim 1, wherein the slurry is filtered through a filter belt to remove the fluid from the slurry.

3. The process of claim 2, wherein the slurry is further filtered through the carrier to remove the fluid from the slurry.

4. The process of claim 3, wherein the carrier is selected from the group consisting of a fabric, veil, mat, film, and combination thereof.

5. The process of claim 4, wherein a negative pressure is used to stabilize the particles in the electrically isolated relationship.

6. The process of claim 5, wherein the particles comprise electrically conductive carbon fibers.

7. The process of claim 6, wherein the particles are bound to the carrier by applying a binder.

8. The process of claim 7, wherein the carrier is incorporated into a composite matrix structure.

* * * * *